US010683856B2

(12) United States Patent
Combrink

(10) Patent No.: US 10,683,856 B2
(45) Date of Patent: Jun. 16, 2020

(54) RECIPROCATING PUMP

(71) Applicant: UDIFLOW LIMITED, Hong Kong (CN)

(72) Inventor: Dirk Pieter Combrink, Vermont (ZA)

(73) Assignee: UDIFLOW LIMITED, Hong Kong (HK)

( * ) Notice: Subject to any disclaimer, the term of this patent is extended or adjusted under 35 U.S.C. 154(b) by 154 days.

(21) Appl. No.: 16/068,339

(22) PCT Filed: Dec. 15, 2016

(86) PCT No.: PCT/IB2016/057643

§ 371 (c)(1),
(2) Date: Jul. 5, 2018

(87) PCT Pub. No.: WO2017/064691

PCT Pub. Date: Apr. 20, 2017

(65) Prior Publication Data

US 2019/0010936 A1 Jan. 10, 2019

(30) Foreign Application Priority Data

Jan. 6, 2016 (ZA) ..... 2016/00394
Jun. 22, 2016 (ZA) ..... 2016/04202

(51) Int. Cl.
*F04B 9/111* (2006.01)
*F04B 53/00* (2006.01)
(Continued)

(52) U.S. Cl.
CPC ..... *F04B 9/111* (2013.01); *F04B 5/02* (2013.01); *F04B 9/10* (2013.01); *F04B 9/1095* (2013.01);
(Continued)

(58) Field of Classification Search
CPC ..... F04B 17/03; F04B 53/006; F04B 53/142; F04B 53/16; F04B 5/02; F04B 9/10; F04B 9/1095; F04B 9/111; F04B 9/115
(Continued)

(56) References Cited

U.S. PATENT DOCUMENTS 83,691 A * 11/1868 Chambers ..... F04B 43/067 417/383
2,946,488 A 7/1960 Kraft
(Continued)

FOREIGN PATENT DOCUMENTS

DE 10 2011 01456 A1 9/2012

OTHER PUBLICATIONS

International Preliminary Report of Patentability dated Jul. 10, 2018, in corresponding International Application No. PCT/IB2016/057643.

*Primary Examiner* — Dominick L Plakkoottam
(74) *Attorney, Agent, or Firm* — Knobbe Martens Olson & Bear LLP

(57) ABSTRACT

A reciprocating pump (10) comprises a first upright leg (12), a second upright leg (14), a first cross-over conduit (18), a second cross-over conduit (18), a lower valve assembly (20) and an upper drive assembly (22). The drive assembly includes plungers (30) which exert alternating downward pumping forces on columns of liquid in the legs (12, 14). The valve assembly is located in a reservoir of water (55) and includes suction openings (80, 64) in the water, which lead into the cross-over conduits (18) and (18), respectively. The valve assembly includes a system of valves and pistons (74, 76) for controlling flow of water into the legs (12, 14) via the cross-over conduits (12, 14) when pumping forces are alternately applied to columns of wafer in the legs (12, 14) wherein water in the legs is raised and lowered in alternating pendulum fashion. Water is drawn into and
(Continued)

alternately forced along the cross-over conduits into the legs where the water is pumped from upper ends of the legs (12, 14) via slots (31) defined in the plungers.

8 Claims, 9 Drawing Sheets

(51) Int. Cl.

| | |
|---|---|
| ***F04B 9/109*** | (2006.01) |
| ***F04B 53/16*** | (2006.01) |
| ***F04B 17/03*** | (2006.01) |
| ***F04B 53/14*** | (2006.01) |
| ***F04B 9/10*** | (2006.01) |
| ***F04B 5/02*** | (2006.01) |
| ***F04B 9/115*** | (2006.01) |

(52) U.S. Cl.
CPC ..... *F04B 9/115* (2013.01); *F04B 17/03* (2013.01); *F04B 53/006* (2013.01); *F04B 53/142* (2013.01); *F04B 53/16* (2013.01)

(58) Field of Classification Search
USPC ..... 417/64; 91/468
See application file for complete search history.

(56) References Cited

U.S. PATENT DOCUMENTS 4,178,240 A * 12/1979 Pinkerton ..... A61M 1/16 137/99
4,938,381 A * 7/1990 Mandeville ..... B29C 44/34 222/1
2011/0265642 A1* 11/2011 Spybey ..... F04B 9/14 91/468

* cited by examiner

RECIPROCATING PUMP

CROSS-REFERENCE TO RELATED APPLICATIONS

This application is a national stage application under 35 U.S.C. § 371 of International Application No. PCT/IB2016/057643, filed on Dec. 15, 2016, which published in English as WO 2017/064691 A1 on Apr. 20, 2017, and which claims priority benefit of ZA Patent Application No. 2016/00394, filed on Jan. 6, 2016, and claims priority benefit of ZA Patent Application No. 2016/04202, filed on Jun. 22, 2016.

FIELD OF INVENTION

This invention relates to a reciprocating pump for pumping a liquid.

SUMMARY OF INVENTION

According to the invention there is provided a reciprocating pump for pumping a liquid, the reciprocating pump including:

an operatively upright first conduit for holding liquid to be pumped, the first conduit having an open upper end and a lower end, the upper end defining a discharge opening through which liquid is discharged from the first conduit under pressure;

an operatively upright second conduit for holding liquid to be pumped, the second conduit having an open upper end and a lower end, the upper end defining a discharge opening through which liquid is discharged from the second conduit under pressure;

a valve assembly located at lower end regions of the first and second conduit, the valve assembly comprising:

a) valve housing defining a first valve chamber and separate second valve chamber which is isolated from the first valve chamber, the first valve chamber being in flow communication with the second conduit and defining a first discharge opening and a first suction opening located in a source of the liquid to be pumped and the second valve chamber being in flow communication with the first conduit and defining a second discharge opening and a second suction opening located in a source of the liquid to be pumped.

b) a first valve set comprising a first one-way discharge valve in the first discharge opening for permitting flow of the liquid from the first valve chamber into the first cross-over conduit but preventing return flow; and a first one-way suction valve in the first suction opening for permitting flow from the source of liquid into the first valve chamber but preventing return flow;

c) a second valve set comprising a second one-way discharge valve in the second discharge opening for permitting flow of the liquid from the second valve chamber into the second cross-over conduit but preventing return flow; and a second one-way suction valve in the second suction opening for permitting flow from the source of liquid into the second valve chamber but preventing return flow;

d) a first piston displaceably located within the first valve chamber, a side of the piston being acted upon by a column of liquid in the first conduit, the first piston being displaceable between a first blocking position wherein the first piston blocks flow of liquid between the first suction opening and the first discharge opening and a second open position wherein flow between the first suction opening and the first discharge opening is permitted;

e) a second piston displaceably located within the second valve chamber, a side of the piston being acted upon by a column of liquid in the second conduit, the second piston being displaceable between a first blocking position wherein the second piston blocks flow of liquid between the second suction opening and the second discharge opening and a second open position wherein flow between the second suction opening and the second discharge opening is permitted; and f) force transferral means for transferring a force applied to one of the pistons by a column of liquid acting on the piston, to the other piston and thereby a column of liquid abutting the other piston, a first cross-over conduit extending between the first discharge opening and the second conduit, providing for flow communication between liquid in the first valve chamber and liquid in the second conduit;

a second cross-over conduit extending between the second discharge opening and the first conduit, providing for flow communication between liquid in the second valve chamber and liquid in the first conduit; and a drive assembly comprising:

a) a first plunger which is displaceably located within the first conduit at its upper end for exerting a downward pumping force on the liquid in the first conduit;

b) a second plunger which is displaceably located within the second conduit at its upper end for exerting a downward pumping force on the liquid in the second conduit; and c) drive means for driving displacement of the first and second plungers in an alternating reciprocating manner wherein the first plunger is driven downwards thereby exerting a downward pumping force on the liquid in the first conduit while the second plunger is simultaneously displaced upwards so as to permit liquid to be discharged from the upper end of the second conduit and wherein the second plunger is thereafter driven downwards thereby exerting a downward pumping force on the liquid in the second conduit while the first plunger is simultaneously displaced upwards so as to permit liquid to be discharged from the upper end of the first conduit.

The reciprocating pump may include a U-shaped conduit which includes the first and second conduit which are provided by upright legs of the U-shaped conduit, the valve housing being provided by a lower conduit section extending between the lower ends of the legs, the lower conduit section having a central divider which sealingly divides the lower conduit section into two parts which define the first and second valve chambers of the valve housing.

The drive means may comprise a motor and a crank which is driven by the motor, the plungers being connected to the crank.

The first and second conduit may have a rigid hollow cylindrical construction at the upper ends thereof. As such, each plunger may have a complementary cylindrical configuration permitting sliding reciprocating displacement of the plungers within the first and second conduits. More specifically, each plunger may comprise a closed upper end and an open lower end, and a hollow cylindrical body extending between the upper and lower ends, the upper end being connected to the crank of the drive means. An external diameter of the body of each plunger may be slightly less than the internal diameter of the upper end regions of the first and second conduits, thereby permitting sliding displacement of the plunger within a particular one of the first and second conduits.

An upper end region of the body of the plunger may define a number of discharge openings in the side wall through which liquid is discharged when the plunger is operatively displaced upwardly and an upper end region of the plunger has risen to a position above an upper end of the first or second conduit within which the plunger is located.

BRIEF DESCRIPTION OF THE DRAWINGS

Further features of the invention are described hereinafter by way of a non-limiting example of the invention, with reference to and as illustrated in the accompanying diagrammatic drawings. In the drawings.

DETAILED DESCRIPTION OF THE INVENTION

Figure 1:
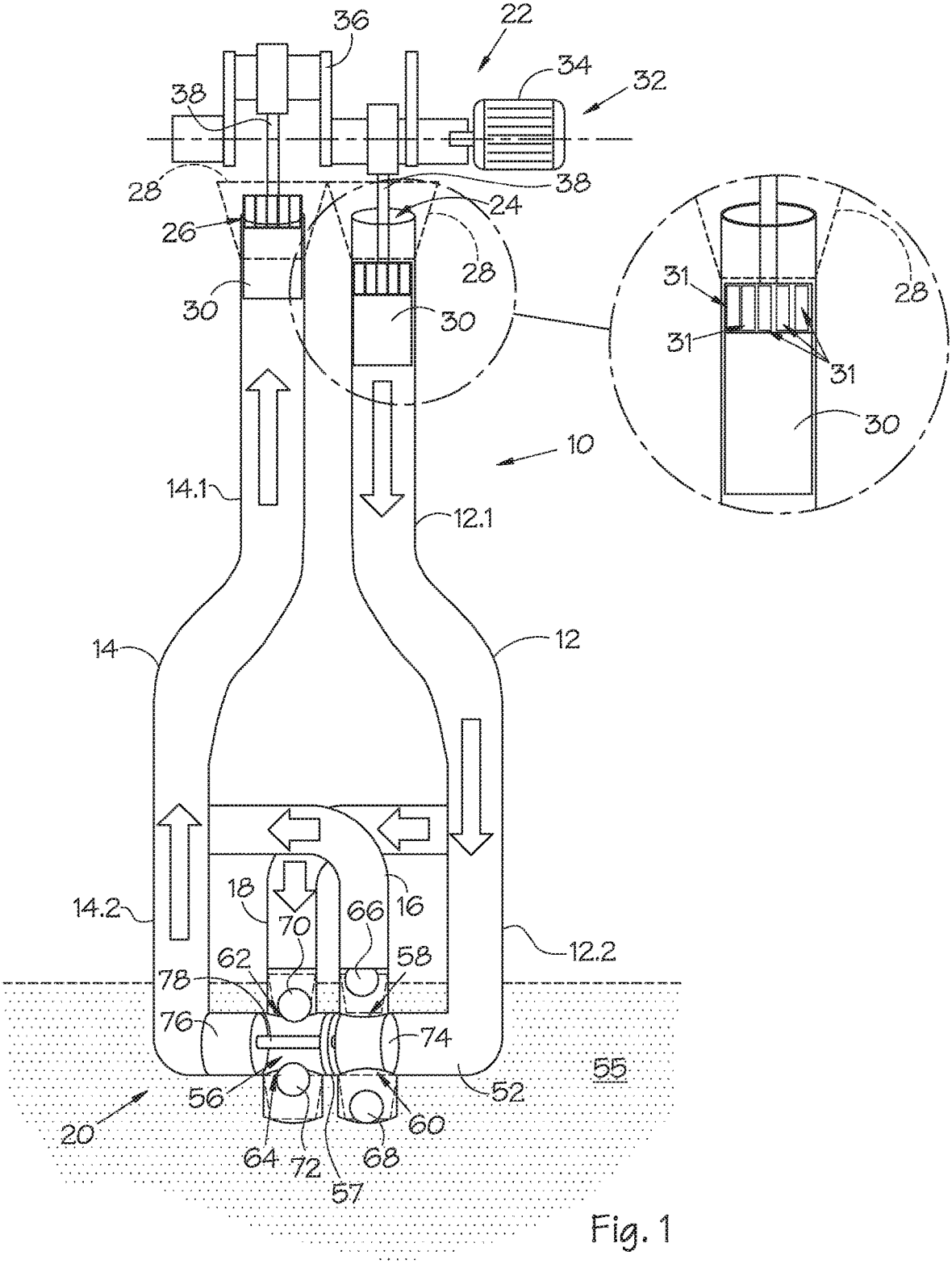
FIG. 1 shows a side elevation of a reciprocating pump in accordance with the invention, in a first mode of operation thereof.

With reference to FIGS. 1 to 7 of the drawings, a reciprocating pump in accordance with the invention is designated generally by the reference numeral 10. The reciprocating pump 10 is adapted for pumping liquids having a specific gravity of not less than one. The reciprocating pump uses an equilibrium hydraulic pump technique for displacing water from a lower elevation to a higher elevation. The Applicant envisages that the reciprocating pump in accordance with the invention may be suitable for drawing water from boreholes, pumping water upwards from mine shafts, pumping water from rivers or dams to reservoirs at a higher elevation, pumping sea water from the ocean to fisheries or desalination plants, filling water tanks atop high buildings, pumping water up to relatively high locations for storage and later use to provide hydroelectric power, etc.

The reciprocating pump 10 comprises, broadly, a first conduit in the form of a first upright leg 12, a second conduit in the form of a second upright leg 14, a first cross-over conduit 16, a second cross-over conduit 18, a valve assembly 20 located at a lower end region of the first and second legs and a drive assembly 22 located at an upper end region of the first and second legs.

The first leg 12 includes an upper rigid cylindrical pipe section 12.1 and a lower flexible pipe section 12.2 which is connected to the upper rigid pipe section 12.1. An upper end 24 of the upper pipe section 12.1 is open. Similarly, the second leg 14 includes a rigid cylindrical upper pipe section 14.1 and a flexible lower pipe section 14.2 which is connected to the upper pipe section. An upper end 26 of the upper pipe section 14.1 is open. Lower end regions of the upper pipe sections 12.1 and 14.1 are threaded so as to provide for connection to the lower flexible pipe sections 12.2 and 14.2, respectively. It will be appreciated that the configuration and construction of the pipe sections of the first and second legs 12 and 14 will depend on the conditions under which the reciprocating pump is used.

Collection cups 28 are located at upper ends of the first and second legs 12 and 14 so as to provide for collection of liquid discharged therefrom as will be explained in detail hereinbelow.

The drive assembly 22 is located above the open ends of the first and second legs. The drive assembly 22 includes a pair of plungers 30 which are each displaceably located within a different one of the first and second legs 12 and 14 at upper ends thereof for exerting a downward pumping force on columns of liquid in the conduits. Each plunger 30 comprises a hollow cylindrical plunger body having a closed upper end and an open lower end, the plunger body defining a number of circumferential spaced discharge slots 31 through which liquid is discharged, in use, into the collection cups 28. An outer diameter of the plunger body is slightly less than an internal diameter of the upper sections of the conduits, such that sliding displacement of the plunger body within a particular one of the conduits is permitted.

The drive assembly further includes a mechanical drive system 32 comprising a variable speed electric motor 34. Connecting rods 38 are connected to upper ends of the plungers 30 and to a crank shaft 36 for driving the plungers up and down within the legs 12 and 14 as the crank shaft rotates. The Applicant envisages that the reciprocating pump will, in a particular application, include a solar collector system and a bank of batteries which are charged by the solar collector system for providing power for operating the motor 34. The reciprocating pump further includes a support platform 40 which is disposed above upper ends of the first and second legs 12 and 14 and crank shaft supports 42 mounted on the support platform, for rotatably supporting the crank shaft. A housing 44 is provided for housing the crank shaft and the connecting rods.

The reciprocating pump includes a liquid collection system 46 including collection pipes 48 which provide for a run off of liquid collected in the collection cups 28 and a run-off conduit 50 into which liquid from the collection pipes 48, flows.

The valve assembly is located within a reservoir of liquid such as water 55 to be pumped and comprises a tubular valve housing 52 which extends between lower ends of the lower pipe sections 12.2 and 14.2 of the first and second legs. More specifically, the housing defines a first valve chamber 54 and a second valve chamber 56 which are isolated from one another by means of a dividing wall 57. The dividing wall 57 is disc-shaped and defines a central aperture. The first valve chamber 54 is in flow communication with the second leg 14 via the cross-over conduit 16, while the second valve chamber 56 is in flow communication with the first leg 12 via the cross-over conduit 18.

The valve housing defines a first discharge opening 58 and a first suction opening 60 in the first valve chamber 54. The discharge opening 58 leads into the cross-over conduit 16, while the suction opening 60 is located in the water 55 to be pumped.

The valve housing defines a second discharge opening 62 and a second suction opening 64 in the second valve chamber 56. The discharge opening 62 leads into the cross-over conduit 18, while the suction opening 64 is located in the water 55 to be pumped.

The valve assembly includes a first valve set for controlling flow of water through the valve chamber 54, comprising a one-way discharge valve 66 located in the discharge opening 58 and a one-way suction valve 68 located in the suction opening 60. More specifically, the discharge valve 66 permits flow of water from the valve chamber 54 into the cross-over conduit 16 but prevents return flow, while the suction valve 68 permits flow of water 55 into the valve chamber 54 via the suction opening 60 but prevents return flow.

The valve assembly includes a second valve set for controlling flow of water through the valve chamber 56, comprising a one-way discharge valve 70 located in the discharge opening 62 and a one-way suction valve 72 located in the suction openings 64. More specifically, the discharge valve 70 permits flow of water from the valve chamber 56 into the cross-over conduit 18 but prevents return flow, while the suction valve 72 permits flow of water from the reservoir 55 into the valve chamber 56 via the suction opening 64 but prevents return flow.

The first cross-over conduit 16 extends between the first discharge opening 58 and the lower pipe section 14.2 of the upright leg 14 providing for flow communication between water in the first valve chamber 54 and a water column in the second leg 14.

The second cross-over 18 extends between the second discharge opening 62 and the lower pipe section 12.2 of the upright leg 12 providing for flow communication between water in the second valve chamber 56 and water in the first leg 12.

The valve assembly further includes a first piston 74 and a second piston 76 which are connected to one another by means of a rigid piston rod 78 which extends between opposed inner sides of the pistons and which passes through the central aperture defined therefor within the dividing wall 57. A water-tight seal is provided within the aperture of the dividing wall and the piston rod 78 which is slidably received therein. The arrangement is such that the pistons are slidably displaceable within the valve housing in a linear reciprocating fashion. External sides of the pistons 74 and 76 are acted upon by columns of water within the first and second legs 12 and 14, respectively. The piston rod 78 is thus operable to transfer a force applied to one of the pistons by a column of water acting on the piston to the other piston and thereby a column of water abutting the other piston, as will be explained in more detail hereinafter.

In the first mode of operation of the reciprocating pump as is illustrated in FIG. 1, the crank shaft 36 has driven the plunger 30 downwards into a column of water within the first leg 12 thereby causing displacement of the piston 74 to the left into a blocking position in valve chamber 54 wherein flow of water between the suction opening 60 and the discharge opening 58 of the valve chamber 54 is blocked. The column of water in the first leg 12 acting upon the piston 74 causes the force of the column of water acting on the piston 74 to be transferred to the piston 76 via the piston rod 78 thereby also displacing the piston 76 to the left and thereby exerting a lifting force on the column of water within the second leg 14. The column of water in the second leg 14 is raised by the same amount the column of water in the first leg 12 is depressed by the plunger 30, causing the plunger 30 in the second leg 14 to be lifted. The plunger in the leg 14 is lifted to a position wherein an upper end region of the plunger 30 is displaced above the upper end 26 of the leg 14 such that the slots 31 are disposed above the upper end 26 causing water displaced upwardly within the leg 14 to be discharged from the conduit via the slots 31 into the water collection cup 28 disposed at the upper end of the leg 14. The discharged water flows down the relevant collection pipe into the run-off conduit 50.

In the first mode of operation of the reciprocating pump, displacement of the piston 76 to the left causes a pressure drop within the valve chamber 56 causing a suction within the chamber which sucks the one-way suction valve 72 into an open position permitting flow of water from the reservoir 55 into the valve chamber 56 via the suction opening 64. The pressure drop within the valve chamber 56 also sucks the one way discharge valve 70 into its closed position preventing flow of water into the cross-over conduit 18. Furthermore, water is forced into the cross-over conduit 18 exerting a closing force on the discharge valve 70.

Figure 2:
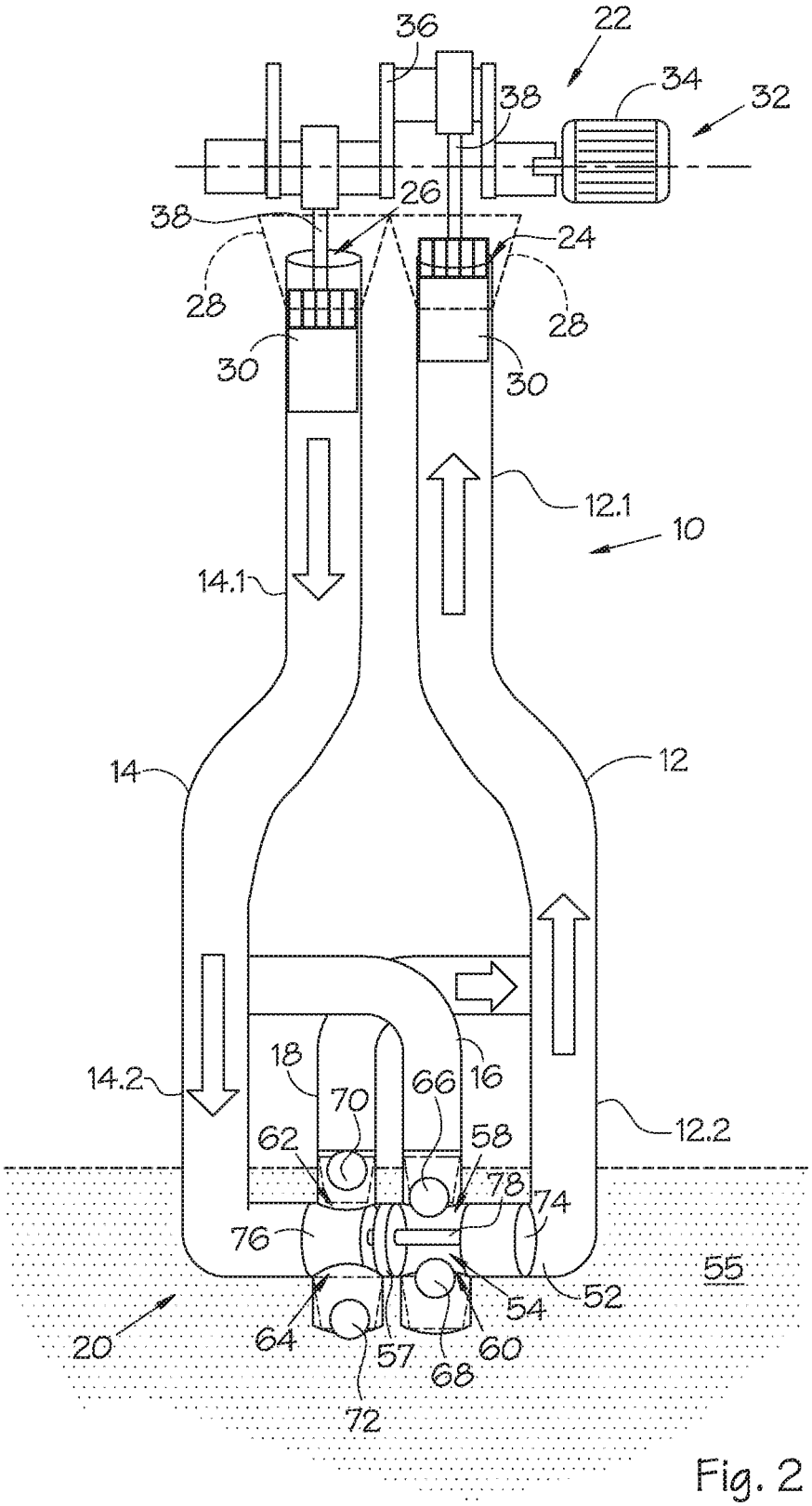
FIG. 2 shows a side elevation of the reciprocating pump of FIG. 1, in a second mode of operation thereof.
Figure 3:
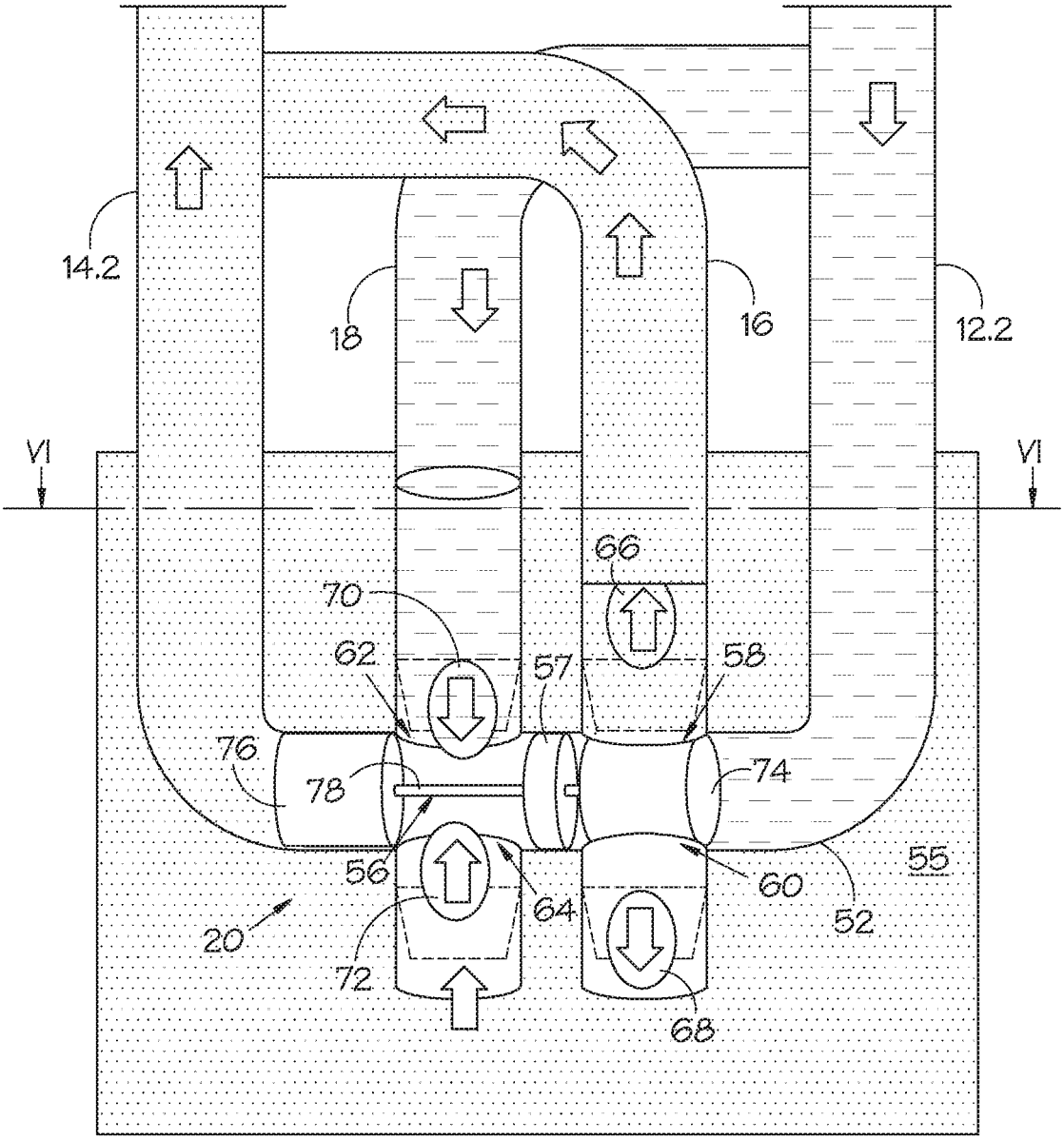
FIG. 3 shows an enlarged fragmentary side elevation of the valve assembly of the reciprocating pump of FIG. 1, in the first mode of operation thereof.
Figure 4:
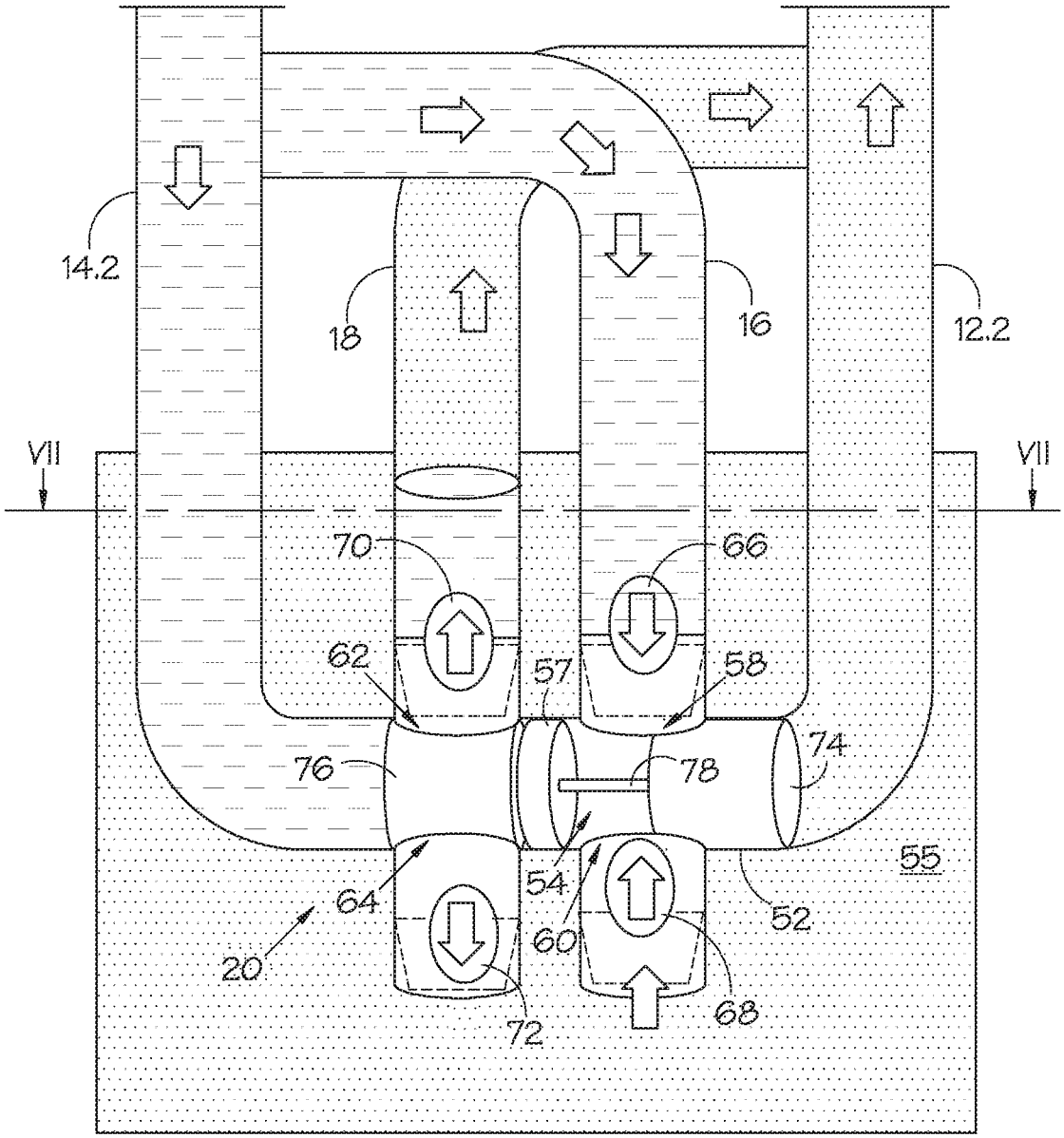
FIG. 4 shows an enlarged fragmentary side elevation of the valve assembly of the reciprocating pump of FIG. 1, in the second mode of operation thereof.
Figure 5:
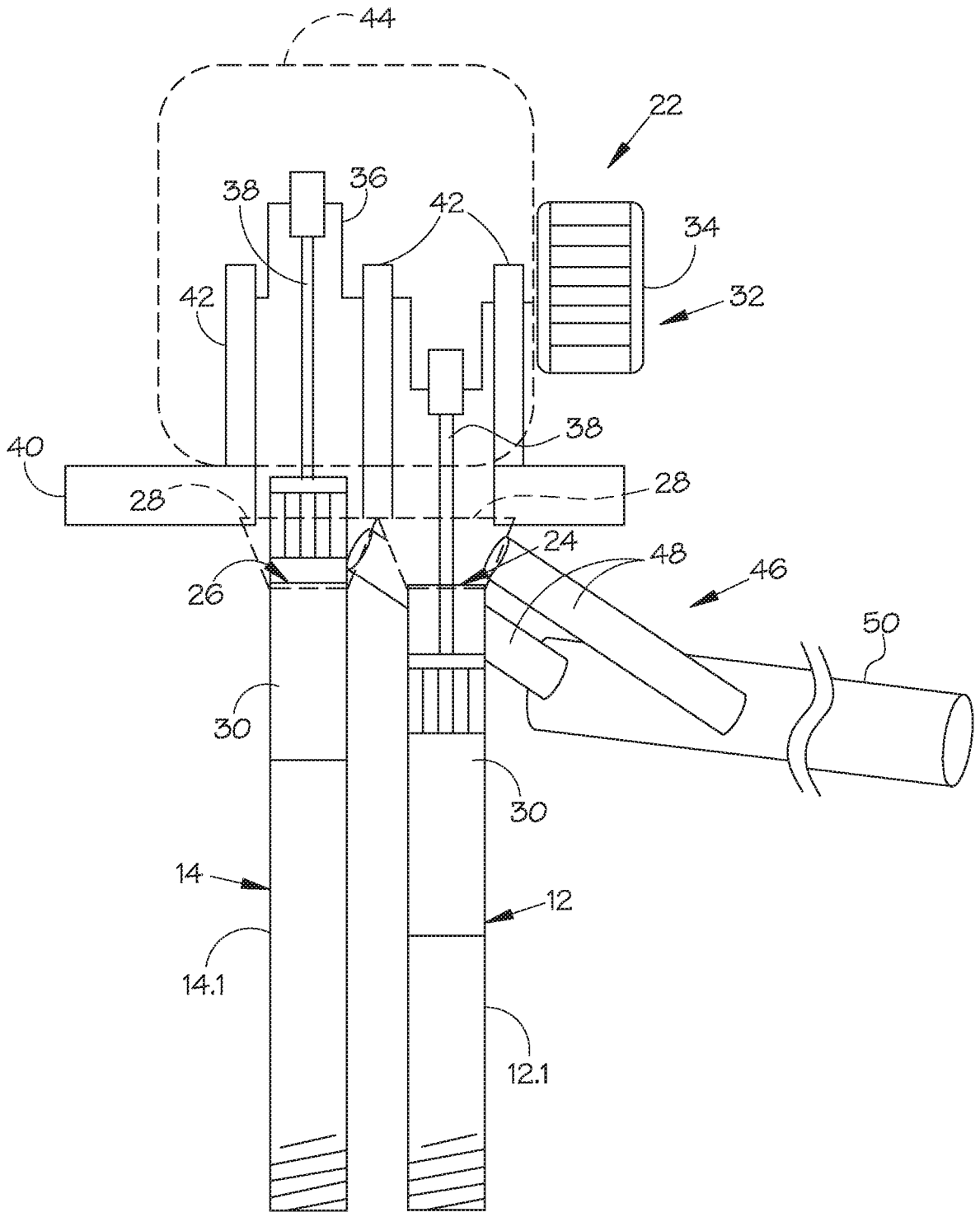
FIG. 5 shows an enlarged fragmentary side elevation of a top structure of the reciprocating pump of FIG. 1, in the first mode of operation thereof.
Figure 6:
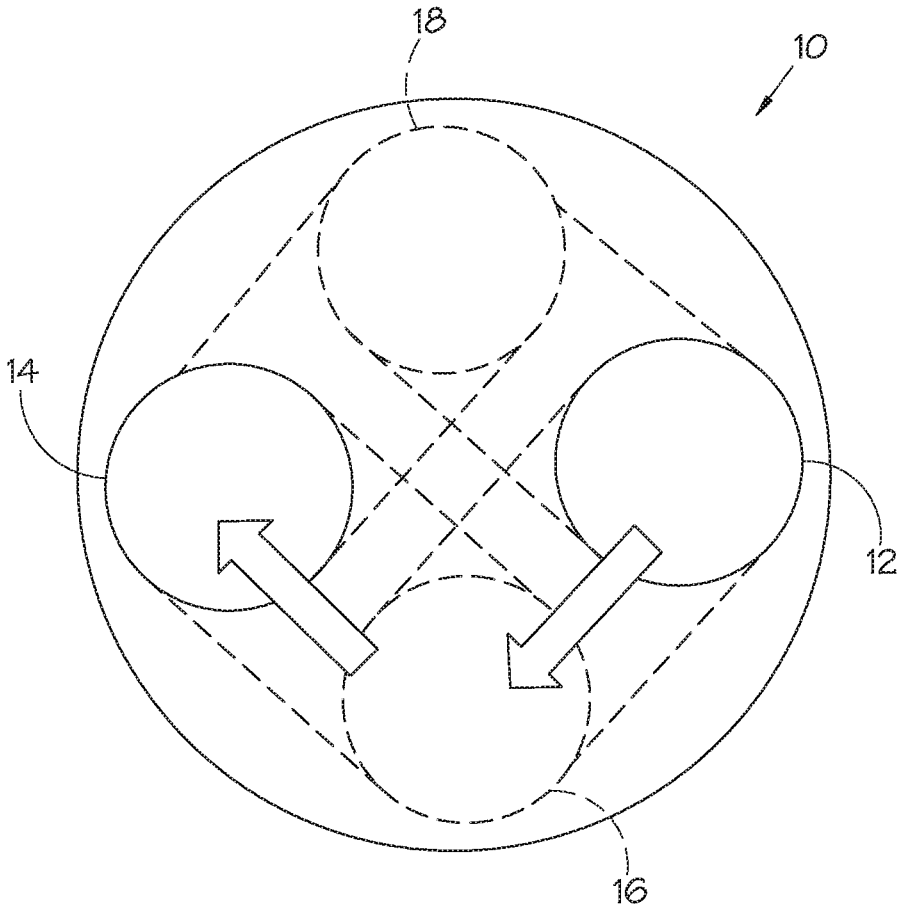
FIG. 6 shows a sectional end view of the reciprocating pump of FIG. 1, as sectioned along sectional line VI-VI of FIG. 3.
Figure 7:
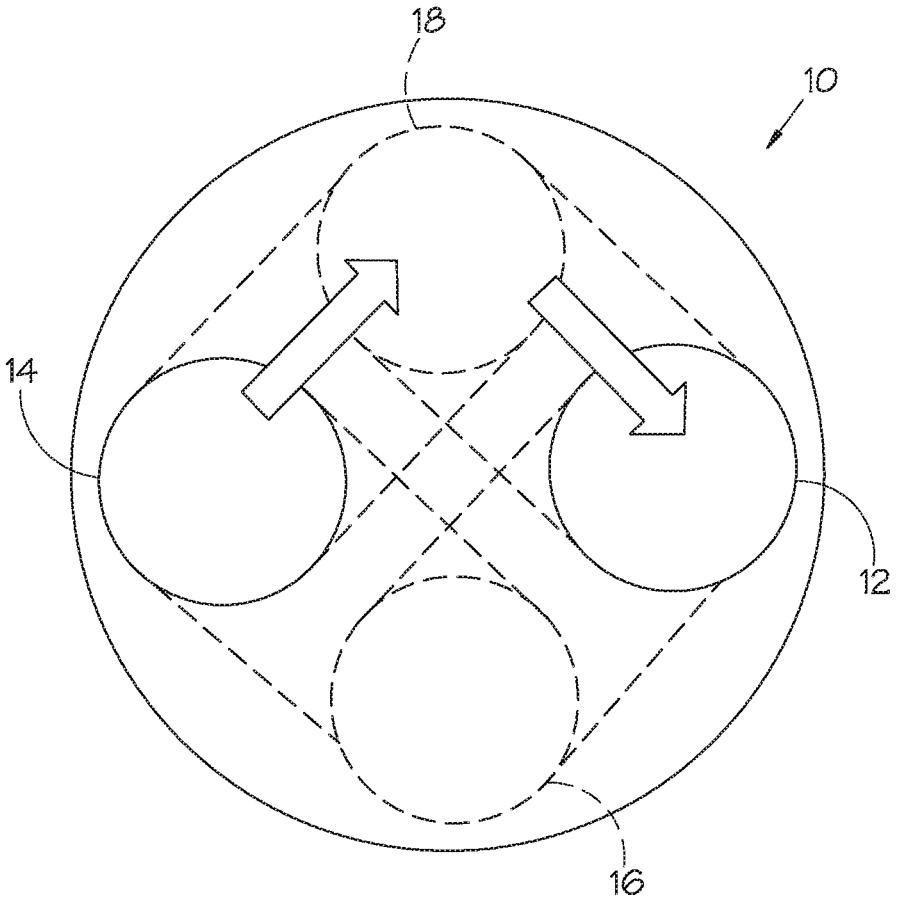
FIG. 7 shows a sectional end view of the reciprocating pump of FIG. 1, sectioned along section line VII-VII of FIG. 4.

In the second mode of operation of the reciprocating pump, as is illustrated in FIG. 2, the crank shaft 36 has driven the plunger 30 downwards into a column of water within the second leg 14 thereby causing displacement of the piston 76 to the right into a blocking position in the valve chamber 56 wherein flow of water between the suction opening 64 and the discharge opening 62 of the valve chamber 56 is blocked. The column of water in the leg 14 acting upon the piston 76 causes the force of the column of water acting on the piston 76 to be transferred to the piston 74 via the piston rod 78 thereby displacing the piston 74 to the right and thereby exerting a lifting force on the column of water within the first leg 12. The column of water in the first leg 12 is raised by the same amount the column of water in the second leg 14 is depressed by the plunger 30, causing the plunger 30 in the first leg 12 to be lifted. The plunger in the leg 12 is lifted to a position wherein an upper end region of the plunger 30 is displaced above the upper end 24 of the leg 12 such that the slots 31 are disposed above the upper end 24 causing water displaced upwardly within the first leg 12 to be discharged from the conduit via the slots 31 into the water collection cup 28 disposed at the upper end of the first leg 12. The discharged water flows down the relevant collection pipe into the run-off conduit 50.

In the second mode of operation of the reciprocating pump, displacement of the piston 74 to the right causes a pressure drop within the valve chamber 54 causing a suction within the valve chamber which sucks the one-way suction valve 68 into an open position permitting the flow of water from the reservoir 55 into the valve chamber 54 via the suction opening 60. The pressure drop within the valve chamber 54 also sucks the one way discharge valve 66 into its closed position preventing flow of water into the cross-over conduit 16. Furthermore, water is forced into the cross-over conduit 16 exerting a closing force on the discharge valve 66.

It will be appreciated that the columns of water in the legs 12 and 14 are raised and lowered in alternating pendulum fashion as the water columns are alternately acted upon by the plungers 30. As such, water drawn into the chambers 54 and 56 during the first and second modes of operation of the reciprocating pump as described hereinabove, is alternatively forced along the cross-over conduits 16 and 18 into the legs 14 and 12, respectively, when the pumping action of the pistons 74 and 76 switch from left to right and vice versa. Water drawn into the valve chamber 54 and 56 replaces the water pumped from the upper ends of the legs 12 and 14.

Figure 8:
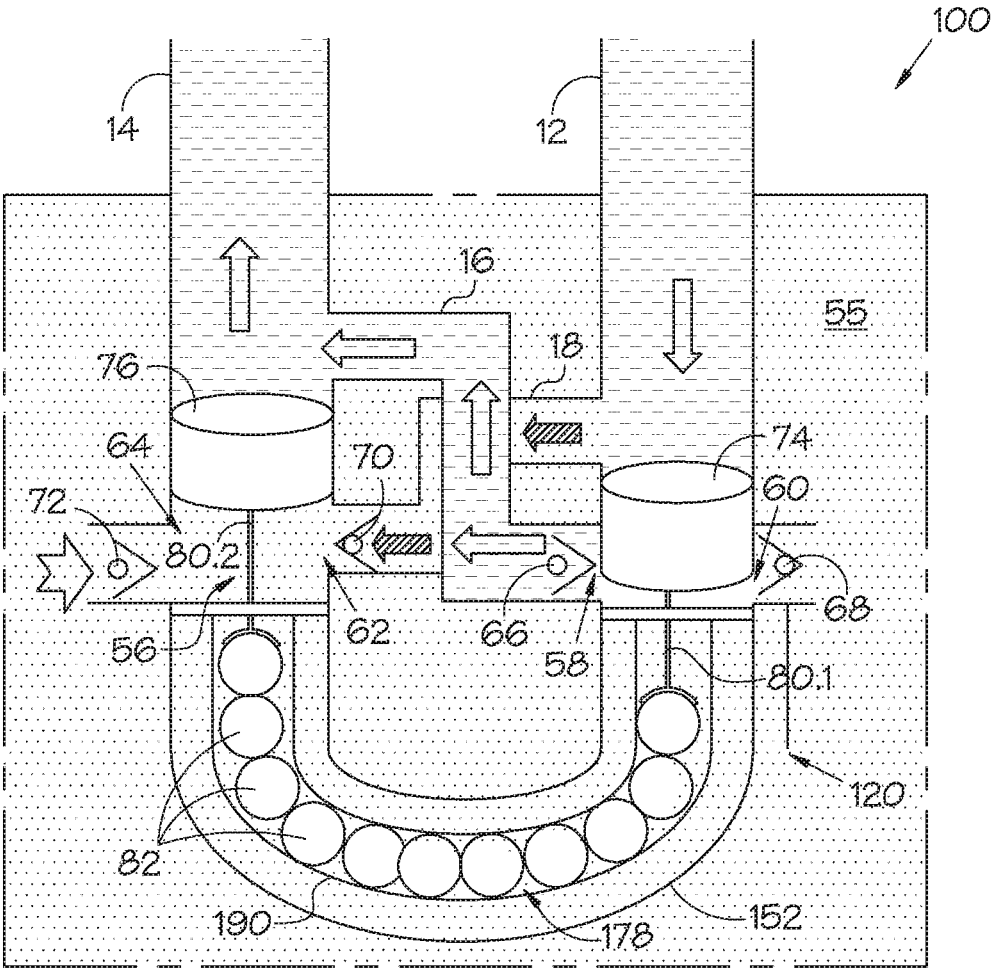
FIG. 8 shows an enlarged fragmentary side elevation of a valve assembly of another embodiment of a reciprocating pump in accordance with the invention, in a first mode of operation thereof.
Figure 9:
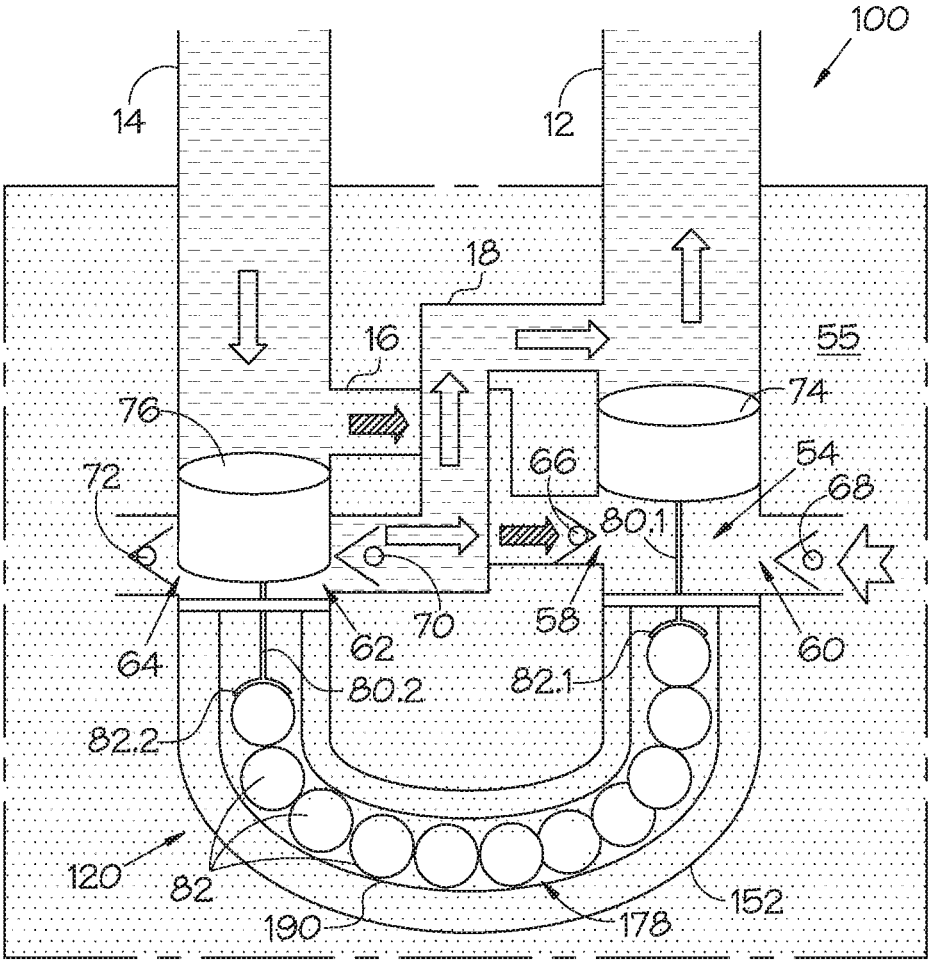
FIG. 9 shows an enlarged fragmentary side elevation of the valve assembly of FIG. 8, in a second mode of operation of the reciprocating pump.

With reference to FIGS. 8 and 9 of the drawings, another embodiment of a reciprocating pump in accordance with the invention is designated by the reference numeral 100.

The reciprocating pump 100 operates on the same principle as the reciprocating pump 10 with the only difference being that the reciprocating pump 100 uses a different force transferral means for transferring a force applied to one of the pistons via a column of water acting on the piston, to the other piston and thereby a column of water abutting the other piston. As such, in FIGS. 8 and 9, the same and/or similar reference numerals are used to designate features of the reciprocating pump 100 which are the same as and/or similar to features of the reciprocating pump 10. In FIGS. 8 and 9, only the lower ends of the legs 12 and 14 and the valve assembly are shown as the upper regions of the legs 12 and 14 and the drive assembly of the reciprocating pump 100 are identical to the upper regions of the legs 12 and 14 and the drive assembly of the reciprocating pump 10.

The reciprocating pump 100 has a valve assembly 120 located at a lower end region of the first and second legs 12, 14. Instead of the piston rod 78 of the reciprocating pump 10, the valve assembly 120 includes a force transferral system 178 comprising a conduit 152 which extends between the valve chambers 54 and 56 within which a plurality of spheres 82 are displaceably located in a row, within an inner guide tube 190. The guide tube 190 contains a lubricating oil to reduce friction when the spheres are displaced within the tube. The force transferral system includes a first push rod 80.1 extending from an inner end of the piston 74 and a second push rod 80.2 extending from an inner end of the piston 76, the push rods 80.1 and 80.2 having abutment formations 82.1 and 82.2, respectively, for pushing on spheres 82 at opposite ends of the row of the spheres held within the guide tube 190. The spheres 82 form a fluid-tight seal within the guide tube 190 and operate in similar fashion to the piston rod 78 of the reciprocating pump 10 for transferring force applied to the piston 74 and 78 by columns of water acting thereon to one another in the same fashion as is the case with the reciprocating pump 10.

As water in the legs 12 and 14 is in equilibrium when not subjected to external forces, the amount of energy required to pump water is relatively small as only sufficient energy is required to lift the measured volume of water to be pumped. It will be appreciated that the size and volumetric delivery of the reciprocating pump can be altered depending on the requirements of the application in which the reciprocating pump is used.

The invention claimed is:

1. A reciprocating pump for pumping a liquid, the reciprocating pump including:

an operatively upright first conduit for holding liquid to be pumped, the first conduit having an open upper end and a lower end, the upper end defining a discharge opening through which liquid is discharged from the first conduit under pressure;

an operatively upright second conduit for holding liquid to be pumped, the second conduit having an open upper end and a lower end, the upper end defining a discharge opening through which liquid is discharged from the second conduit under pressure;

a valve assembly located at lower end regions of the first and second conduit, the valve assembly comprising:

a) valve housing defining a first valve chamber and separate second valve chamber which is isolated from the first valve chamber, the first valve chamber being in flow communication with the second conduit and defining a first discharge opening and a first suction opening located in a source of the liquid to be pumped and the second valve chamber being in flow communication with the first conduit and defining a second discharge opening and a second suction opening located in a source of the liquid to be pumped;

b) a first valve set comprising a first one-way discharge valve in the first discharge opening for permitting flow of the liquid from the first valve chamber into a first cross-over conduit but preventing return flow; and a first one-way suction valve in the first suction opening for permitting flow from the source of liquid into the first valve chamber but preventing return flow;

c) a second valve set comprising a second one-way discharge valve in the second discharge opening for permitting flow of the liquid from the second valve chamber into a second cross-over conduit but preventing return flow; and a second one-way suction valve in the second suction opening for permitting flow from the source of liquid into the second valve chamber but preventing return flow;

d) a first piston displaceably located within the first valve chamber, a side of the piston being acted upon by a column of liquid in the first conduit, the first piston being displaceable between a first blocking position wherein the first piston blocks flow of liquid between the first suction opening and the first discharge opening and a second open position wherein flow between the first suction opening and the first discharge opening is permitted;

e) a second piston displaceably located within the second valve chamber, a side of the piston being acted upon by a column of liquid in the second conduit, the second piston being displaceable between a first blocking position wherein the second piston blocks flow of liquid between the second suction opening and the second discharge opening and a second open position wherein flow between the second suction opening and the second discharge opening is permitted; and f) force transferral means for transferring a force applied to one of the pistons by a column of liquid acting on the piston, to the other piston and thereby a column of liquid abutting the other piston, the first cross-over conduit extending between the first discharge opening and the second conduit, providing for flow communication between liquid in the first valve chamber and liquid in the second conduit;

the second cross-over conduit extending between the second discharge opening and the first conduit, providing for flow communication between liquid in the second valve chamber and liquid in the first conduit; and a drive assembly comprising:

a) a first plunger which is displaceably located within the first conduit at its upper end for exerting a downward pumping force on the liquid in the first conduit;

b) a second plunger which is displaceably located within the second conduit at its upper end for exerting a downward pumping force on the liquid in the second conduit; and c) drive means for driving displacement of the first and second plungers in an alternating reciprocating manner wherein the first plunger is driven downwards thereby exerting a downward pumping force on the liquid in the first conduit while the second plunger is simultaneously displaced upwards so as to permit liquid to be discharged from the upper end of the second conduit and wherein the second plunger is thereafter driven downwards thereby exerting a downward pumping force on the liquid in the second conduit while the first plunger is simultaneously displaced upwards so as to permit liquid to be discharged from the upper end of the first conduit.

2. The reciprocating pump as claimed in claim 1, wherein the reciprocating pump includes a U-shaped conduit which includes the first and second conduit which are provided by upright legs of the U-shaped conduit, the valve housing being provided by a lower conduit section extending between the lower ends of the legs, the lower conduit section having a central divider which sealingly divides the lower conduit section into two parts which define the first and second valve chambers of the valve housing.

3. The reciprocating pump as claimed in claim 1, wherein the drive means comprises a motor and a crank which is driven by the motor, the plungers being connected to the crank.

4. The reciprocating pump as claimed in claim 1, wherein the first and second conduit have a rigid hollow cylindrical construction at the upper ends thereof.

5. The reciprocating pump as claimed in claim 4, wherein each plunger has a complementary cylindrical configuration permitting sliding reciprocating displacement of the plungers within the first and second conduits.

6. The reciprocating pump as claimed in claim 5, wherein each plunger comprises a closed upper end and an open lower end, and a hollow cylindrical body extending between the upper and lower ends, the upper end being connected to the crank of the drive means.

7. The reciprocating pump as claimed in claim 6, wherein an external diameter of the body of each plunger is slightly less than the internal diameter of the upper end regions of the first and second conduits, thereby permitting sliding displacement of the plunger within a particular one of the first and second conduits.

8. The reciprocating pump as claimed in claim 7, wherein an upper end region of the body of each plunger defines a number of discharge openings in a side wall through which liquid is discharged when each plunger is operatively displaced upwardly and an upper end region of each plunger has risen to a position above an upper end of the first or second conduit within which the respective plunger is located.

* * * * *